United States Patent [19]

Hall

[11] 4,277,990

[45] Jul. 14, 1981

[54] RATCHET WRENCH

[75] Inventor: Roy L. Hall, Hoffman Estates, Ill.

[73] Assignee: Duro Metal Products Company, Chicago, Ill.

[21] Appl. No.: 94,213

[22] Filed: Nov. 14, 1979

[51] Int. Cl.[3] ..... B25B 13/46

[52] U.S. Cl. ..... 81/63

[58] Field of Search ..... 81/63, 62; 192/43.1

[56] References Cited

U.S. PATENT DOCUMENTS

| | | | |
|---|---|---|---|
| 1,888,885 | 11/1932 | Pepperdine | 81/63 |
| 3,145,594 | 8/1964 | Peters | 81/63 |
| 3,265,171 | 8/1966 | Kilness | 81/63 |

FOREIGN PATENT DOCUMENTS

| | | | |
|---|---|---|---|
| 1029033 | 3/1953 | France | 81/63 |

*Primary Examiner*—James L. Jones, Jr.

[57] ABSTRACT

A ratchet wrench for supporting removable wrench sockets of simplified construction employing a two-chambered pear shaped housing journaling a ratchet gear and a one-piece combined pawl and pawl reversal lever which are supported on parallel axes for limited rotational movement in mutual bearing engagement; such ratchet gear and pawl receiving additional bearing support from the walls of their respective chambers and being maintained in their rotational operating positions by a single retaining ring.

6 Claims, 4 Drawing Figures

RATCHET WRENCH

BACKGROUND AND SUMMARY OF THE INVENTION

The present invention relates to ratchet wrenches for driving or torquing sockets having a nut or bolthead driving cavity, and more particularly concerns a simplified structural arrangement and combination of elements for such a wrench.

In a typical ratchet wrench, of the character to which the present invention pertains, an elongated turning handle or lever is provided with an enlarged housing at one end in which are journalled a ratchet gear and a multiple toothed-pawl, the latter of which is selectively positionable by an operating lever to permit the ratchet gear to revolve in clockwise or counterclockwise directions. Thus a wrench socket attached to the ratchet gear via a tang or coaxially extending stub shaft thereof is likewise rotatably driven for the purpose of tightening or loosening a nut or bolthead engaged thereby. Typically such wrench sockets are removably secured to the tang or stub shaft by detent means and the ratchet gear engaging position of the pawl is similarly maintained via detent means in response to selected actuation of the pawl actuating lever. Bearing support for the rotatable pawl and ratchet gear are usually provided by bored openings extending through the walls of the multi-chambered housing of the wrench and/or one or more removable cover plates for enclosing the housing chambers. In some instances such cover plate or plates are secured to the housing by machine screws or locking rings. In the case of the single cover plate structure, bearing openings for the pawl and pawl lever normally are provided in the cover plate as well as in the wrench housing. A bearing support system for the ratchet gear is provided by axially extending bearing shoulders on the gear which are received in the cover or housing openings. In those instances where two cover plates are employed, openings or internally extending bearing bosses on the cover plates provide the required bearing support for the rotatable pawl and ratchet gear members. In either instance the provision of the detachable or removable cover plate or plates utilizing multiple fastening means along with the manner of providing bearing support for the movable ratchet gear and pawl, as heretofore practiced, have led to difficulties of manufacture and assembly and uneconomic consumption of time and labor. These problems are avoided according to this invention.

A principal object of this invention is to provide an improved ratchet wrench incorporating a rotatable pawl regulated ratchet gear which is of simplified construction, employing a minimum of parts leading to economics of manufacture and assembly.

Another object of this invention is to simplify the construction of a ratchet wrench for driving detachable wrench sockets which exhibits improved strength and operational capabilities.

Still another object of this invention is to provide a simplified assembly of elements for a ratchet wrench having a unified or one-piece pawl and pawl reversal lever.

Still another object of this invention is to provide an improved ratchet wrench, as set forth in the immediately preceding objective, in which rotatable ratchet gear and pawl members maintain bearing support on one another and adjacent walls of chamber bores in which they are housed.

Still another important object of this invention is to provide a new and improved ratchet wrench employing a rotatable ratchet gear, and a rotatable combined pawl and a pawl lever which are retained in a multiple chambered housing by a single retaining means.

Having thus described this invention, the above and further objects, features and advantages thereof will appear from the following description of an illustrated embodiment set forth in the accompanying drawings.

DESCRIPTION OF THE PREFERRED EMBODIMENT

The structure depicted in the accompanying drawings is not intended to serve as a limitation upon the scope, teaching or concepts of the present invention, but is merely illustrative thereof. Further, within the skill of the art, there are obvious variations and adaptions of the herein set forth teachings of this invention, taken in whole or in part, depending on commercial adaptations, uses and requirements.

Figure 1:
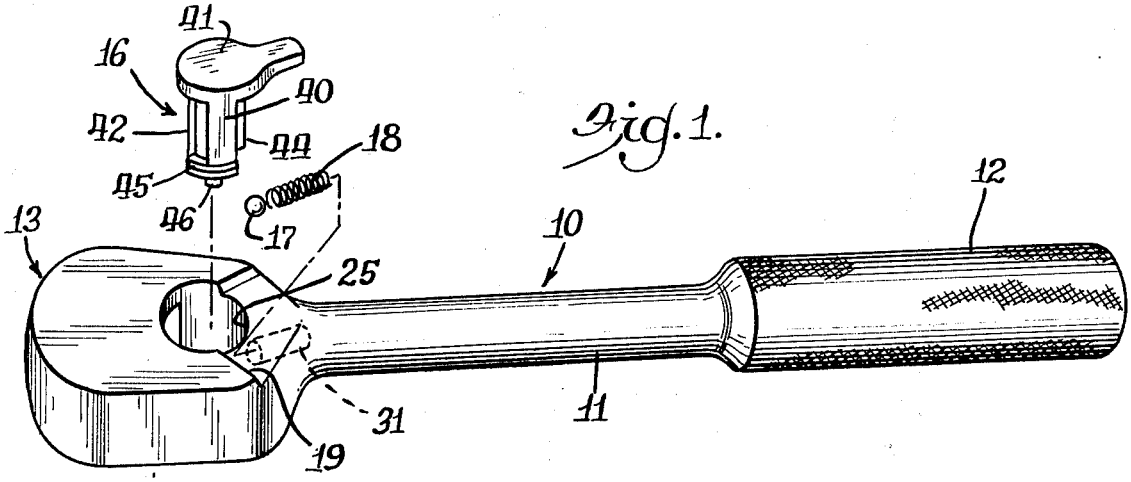
FIG. 1 is an exploded perspective view of a ratchet wrench according to this invention, illustrating the arrangement of parts incorporated therein.

As best shown in FIG. 1, the illustrated embodiment comprises an elongated wrench turning handle 10 incorporating a generally cylindrical shank portion 11 having a knurled hand grip portion 12 of generally cylindrical configuration formed integrally with and comprising the outer end of the shank portion 11. The opposite end of the shank portion is equipped with an enlarged ratchet housing portion 13 which preferably, as shown, is integral with the shank portion 11 and of a so-called "pear-shaped" although other shapes and configurations for the housing 13 may be employed. For certain applications the housing portion 13 may be movably secured to the inner end of the shank portion 11 in accordance with known practice.

Housing portion 13 is internally chambered to receive a toothed rotatable ratchet gear member 14 formed integrally with a depending or axially extending drive tang 15 in accordance with recognized practice. A novel combined unitary pawl lever and pawl member 16 is journaled in a secondary chamber of the housing 13 for rotation about a axis parallel to the rotational axis of the ratchet gear 14. A ball detent 17 and actuating spring means 18 are journaled in the handle shank portion 11 and disposed to operationally engage the pawl portion of member 16 to retain the latter in one of two extreme operation positions for opposite directional ratcheting of the gear member 14 in a known manner. The pawl lever portion of member 16, is protectively positioned in an arcuate sector-shaped recess 19 formed in the upper wall or side of housing portion 13. Uniquely the two operating members 14 and 16, namely, the ratchet gear and the combined pawl and pawl lever members are retained in the housing portion 13 by a single retainer ring means 20.

Having enumerated the various parts and portions of the improved assembly according to this invention, the specifics of each will now be set forth in greater detail.

Figure 2:
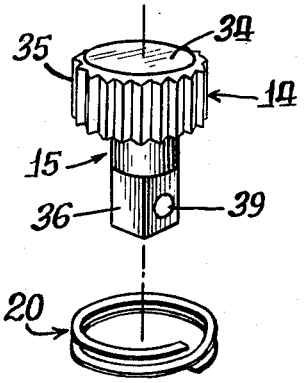
FIG. 2 is an enlarged bottom plan view of the assembled wrench with the handle portion thereof broken away.
Figure 2:
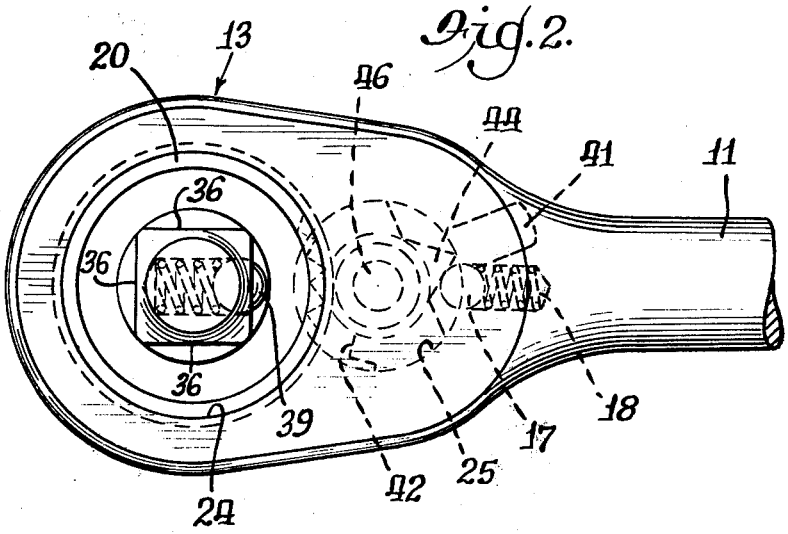
Figure 3:
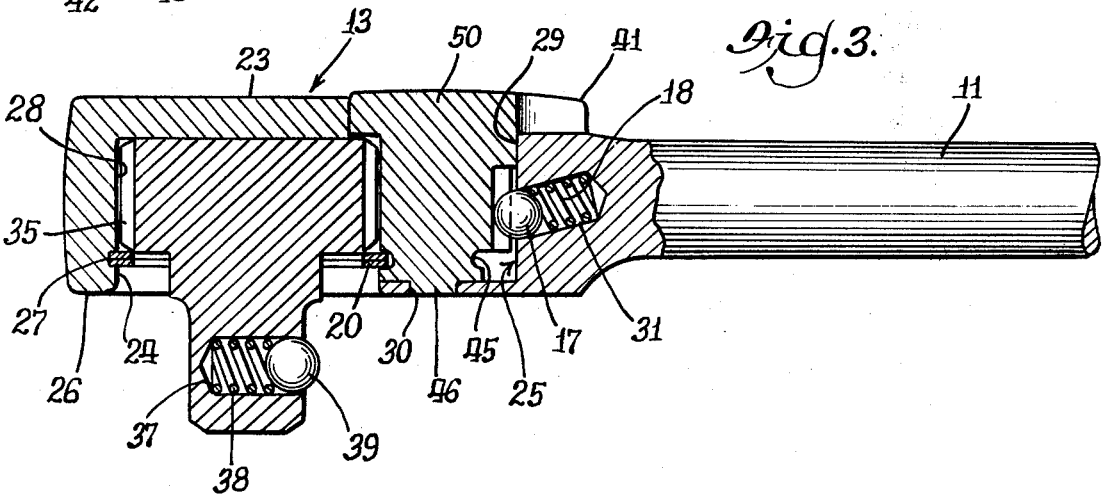
FIG. 3 is a side elevational view of the assembled wrench with portions thereof shown in vertical cross-section and the handle portion foreshortened.

With reference to FIGS. 1–3, it will be recognized that the handle member 10 is of generally conventional configuration, preferably constructed as a metal forging for strength. The handle member, of course, is utilized for applying torque to various size wrench sockets (not shown) which are removably attached to the drive tang 15 of the rotatable ratchet gear 14. While the overall characteristics and construction of the handle member 10 are conventional, as above indicated, the housing portion 13 thereof is not.

Externally portion 13 is preferably pear shaped in accordance with the current illustration, however, that is not essential inasmuch as the exterior configuration of the housing is of no great moment to the merits and concepts of the current invention. One basic departure of the housing portion 13 from prior known wrenches of this class, resides in its lack of a bearing opening through the upper wall portion 23 thereof or, alternatively, the provision of a depending bearing boss on the interior face of such wall portion 23 for the purpose of providing bearing support to the ratchet gear member 14. Further departure is readily apparent in that there is no cover plate associated with the housing portion 13 in accordance with previous practice.

Be that as it may, the housing portion 13 is requisitely provided with a pair of internal chambers 24 and 25 (see FIGS. 2 and 3), each of cylindrical configuration and having overlapping of interferingly aligned peripheries or circumferences, the purpose of which will appear presently. Chamber 24 is formed inwardly of a bottom wall 26 of the housing portion 13 while chamber 25 is formed or bored inwardly of the upper wall 23 thereof. Chamber 25 further communicates openly at its upper end with the sector-shaped recess 19 formed inwardly to the housing upper wall 23, adjacent its junction with the handle shank portion 11 for protectively journaling the ratchet lever portion of member 16 as previously noted (see FIG. 3).

Chamber 24 is, as above noted, cylindrical in configuration and closed over at its upper end by the upper wall 23 of the housing (see FIG. 3). Adjacent the lowermost end of such chamber 24 and spaced axially inwardly of the bottom wall 26 of the housing portion, is a recessed kerf 27 extending radially beyond the cylindrical side walls 28 of chamber opening 24 for the purpose of receiving the retainer locking ring 20, as will be described hereinafter.

Chamber 25 as best illustrated in FIG. 3, has straight cylindrical side walls 29 of a cylindrical diameter closely receptive of the pawl lever and pawl member 16 in assembly; such wall 29 being partly interrupted by adjacent chamber 25 due to the overlappingly aligned cylindrical walls of the chambers. Thus, the two chambers 24 and 25 openly communicate along a portion of their circumferential peripheries for the inter-engaging cooperation of the ratchet wheel and pawl member in assembly. Bottom wall 26 of the housing is further provided with a small opening 30, coaxial of chamber 25 for purposes of providing guiding alignment to the pawl member, as will be described hereinafter. While the opening 30 is illustrated in the herein described embodiment, an alternative arrangement is equally available comprising an upwardly projecting centering boss formed on bottom wall 26 aligned to cooperate with a corresponding recess in the bottom end of the pawl member 16 for purposes of centrally aligning such member in its journaling chamber 25.

In addition to the two chamber 24 and 25 of the housing portion 13, the side wall 29 of the pawl chamber 25 is invaded at one side by an inclined bore 31, receptive of the detent ball and spring means 17 and 18 for purposes of maintaining the rotatable pawl member 16 in selected operating positions in accordance with known and recognized practice.

Turning now to the features of the ratchet gear member 14, the same is best illustrated in FIGS. 1 and 3 of the drawings. As there shown, the ratchet gear 14 has the usual cylindrical body 34 formed with straight gear teeth 35 about its periphery and a cylindrical tang or stub shaft 15 extending coaxially from the lower side of body portion 34. The tang is provided with intersecting planer surfaces 36 forming, in the illustrated case, a square cross-sectional drive means engageable with a corresponding drive chamber of a removable wrench socket in accordance with familiar practice. The drive section of the tang is bored inwardly on one face to provide a bore or chamber 37 (see FIG. 3) receptive of a spring means 38 and a detent ball 39; the latter of which is maintained in the detent chamber by spinning over the metal at the outer end of the chamber 37 in a known manner. This arrangement, provides means for detachably securing a wrench socket to the drive tang.

The outside diameter of the gear's body portion 34 is substantially equal to the diameter of the chamber 24 within which the ratchet gear is journaled in operation except for a slight clearance therebetween to permit rotational movement of the ratchet gear within its chamber. By making the chamber and ratchet gear close-fitting in this manner, the side walls 28 of the chamber 24 provide bearing support for the ratchet gear in operation. To that end it will be noted that the standard ratchet gear familiarly employed in ratchet wrenches of the prior art, differ from the illustrated member 14 in that such a standard ratchet gear is formed with axial extending bosses above and below its toothed body portion which are receptive in sockets or openings in cover plates or in the housing portion of the wrench to provide the necessary bearing support for the gear. Such construction is eliminated by the utilization of the chamber side walls for the bearing means in accordance with the current invention. This feature greatly simplifies the design and construction of the gear member as well as the need to provide accurately aligned bearing recesses or openings in the housing and/or cover plate in accordance with previous practice.

Turning now to the features of the combined pawl and lever member 16, the same is best shown in FIGS. 1 through 4 of the drawings from which it will be appreciated that the body portion 40 thereof is integrally formed, as by investment casting, with the ratchet reversal lever portion 41. This provides a stronger structure than the heretofore known pawl and lever assemblies in which the lever is detached from the pawl body and fastened to the latter in assembly. This structural feature and arrangement further reduces assembly time and provides a part which is not only stronger, but is less likely to be damaged in use.

Figure 4:
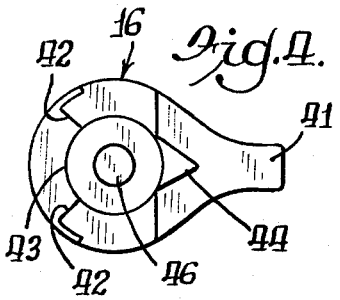
FIG. 4 is a bottom plan view of the combined pawl and pawl lever member shown in cross-section in FIG. 3.

As shown best in FIGS. 3 and 4, the body portion 40 of the pawl member is generally cylindrical and depends from the integrally joined ratchet lever portion 41. The outside diameter of body 40 substantially conforms to the inside diameter of chamber 25 for close-fitting bearing engagement with the side walls 29 of the latter. Two separate gear engaging teeth 42, 42 are provided along a circumferential sector of the body portion 40; such teeth being separated by an intervening cut-out or recessed circumferential area 43 in portion 40 with the teeth being disposed symetrically of a central plane passing through the vertical axis of the body portion (see FIG. 4).

Located along the same central plane and symetrical with respect thereto is a single protruding third tooth 44, engageable with the ball detent 17 in operation for selectively positioning the pawl member, in right or left hand operational positions whereby to accordingly regulate the directional rotation of the ratchet gear in a known manner. It will be recognized that in assembly with the ratchet gear, each tooth 42 of the pawl member selectively engages the teeth 35 of the gear member, one at a time; the circumferences of the gear and pawl members being in an overlapping and interfering relation as best shown in FIGS. 2 and 3. This interengagement of the two members provides mutual bearing support therebetween in addition to the bearing support provided by the side walls of the respective chambers in which the gear and pawl are journaled in the wrench housing portion 13.

In addition to the teeth 42, 42, and 44 as above described, the cylindrical body portion of the pawl member is further provided with a annular kerf 45 radially inset adjacent its lower end and, in the particular illustrated embodiment, also with a small diametered cylindrical guide or boss portion 46 extending axially from its lower end for reception in the bored opening 30 in the bottom wall of the housing 13. As previously noted, the guiding function provided by the boss 46 and opening 30 for maintaining the pawl member in its operationally aligned position within chamber 25 also may be effected by alternatively providing an inset recess in the lower end of the pawl body portion 40 and a mating projection extending upwardly from the bottom wall 26 of the housing. In any event, such guide means are preferred in accordance with the illustrated structure for high torque load wrench assemblies. Wrenches designed for relatively light torque loads are operationally satisfactory without the guide means at the lower end of the pawl member and in those cases, such feature may be eliminated.

As previously noted, the usual detent ball 17 and its actuating spring 18 are assembled in the chamber 31 which is herein disclosed as being disposed on a inclined axis in accordance with conventional practice. The ball 17 operationally engages opposite sides of the single detent tooth 44 of the pawl member with the detent ball 17 riding freely in and out of the chamber 31 in accordance with the urgings of spring 18.

In the assembly of the ratchet gear member 14 and the pawl member 16 within their respective chambers 24 and 25 shown in FIG. 3, it will be noted that the upper end of the gear body 34 engages the bottom face of housing wall 23 and that corresponding engagement occurs between the bottom end of the pawl body and the bottom wall 26 of the housing. So positioned, the locking ring kerf 27 formed in the side walls of chamber 24 aligns with the kerf 45 of the pawl member whereby the single locking or retainer ring 20 simultaneously engages both kerfs to lock members 14 and 16 is their operating positions in the housing chambers.

In the illustrated case the retainer 20 comprises a multiple turn helical spring steel member which is rotatably engaged with the two locking kerfs, particularly filling the kerf 27 whereby to avoid vertical play or movement of the ratchet gear member 14 within its chamber. It will be noted that kerf 45 in the pawl member is formed with slight vertical clearance with respect to the mounted locking ring 20 to facilitate relatively free rotational movement of the pawl member.

As previously noted, the upper end of the pawl member 16 is provided with the ratchet lever portion 41 which comprises a manually engageable means for selectively moving the pawl member rotatably against the biasing forces of the detent means 17 and its associated spring 18. Of no little importance is the fact that the configuration of the lever portion 41 is such as to provide a substantially cylindrical head portion 50 integral with the upper end of the pawl's body portion 40 and having a diameter equal to that of the body portion. Importantly the side walls of head portion 50 fit closely with the upper end of the bored chamber 25 so as to closely fit the upper regions of its side walls 29, assisting in the rotatable bearing support of the pawl member. Such relationship is best illustrated in FIG. 3 of the drawings.

Having thus described the combination of elements involved in the current invention it will be appreciated by those of skill in the art that the number of parts involved in the described wrench assembly is substantially less than employed in heretofore known conventional ratchet wrenches of this class. Including the ball detent means and springs, the total number of parts involved in the assembly of this invention is in the order of eight as opposed to eleven or more pieces in the conventional ratchet wrench of the prior art. This reduction in number of parts, of course, greatly simplifies manufacture and assembly procedures, leading to economies of production. In particular the unification of the ratchet pawl and its operating lever, the provision of bearing support by the side walls of the chambers in which the ratchet gear and pawl member are journaled, as well as their mutual bearing interengagement, plus the capability of interlocking all parts with a single retainer ring provides an improved wrench of simplified construction, improved operational capabilities, increased strength and dependability, thus marking the present invention as a meritorious advancement in the art.

Further it will be understood and appreciated that while this invention has been hereinabove described in association with a particular prefered embodiment thereof, illustrative of the best mode presently contemplated for carrying out its concepts and teachings, the same is susceptible to obvious modifications and substitutions of parts and equivalents without departing from the spirit and scope of its inventive teachings which are to be unlimited by the foregoing, except as may appear in the following appended claims.

The embodiments of the invention in which an exclusive property or privilege is claimed are defined as follows:

1. A ratchet wrench for driving removable drive sockets having bolt head or nut engaging means, comprising: an elongated handle member, an enlarged housing at one end of said handle member, formed with two internal cylindrical chambers, each closed over at one end by an integral portion of said housing, and having parallel axes and overlapping circumferences whereby said chambers openly communicate at their overlapping areas; one of said chambers having one open end which extends inwardly of an upper wall of said housing and the other of said chambers having one open end which extends inwardly of the bottom wall of said housing; a ratchet pawl member rotatably journaled in said one of said chambers in bearing relation with the walls thereof; a ratchet gear member having a toothed body and an axially depending socket supporting drive tang, rotatably journaled in the other of said chambers in bearing relation with the walls thereof; said pawl member having a pair of arcuately spaced teeth selectively engageable one at a time with the teeth of said gear member, yieldable detent means for maintaining said pawl member in either of two selected operating positions whereby to engage one of said pair of teeth with said gear member to thereby limit ratcheting rotation of the latter in clockwise or counter clockwise directions; and a single retainer means disposed within the confines of said housing and operable for simultaneously locking both said gear and pawl members in their respective chambers.

2. The combination of claim 1 wherein said retainer means is resiliently deformable, and said other of said chambers and said pawl member are provided with coplanar aligned recessed kerfs lockingly receptive of said retainer means.

3. The combination of claim 1 wherein said pawl member is joined with an operating lever manually accessible exteriorly of said upper wall of said housing.

4. The combination of claim 3 wherein said pawl member and operating lever are integrally unified and said lever is disposed in a recessed area in said upper wall.

5. The combination of claim 1, and guide means at the lower end of said pawl member for rotatably guiding the same.

6. The combination of claim 1, wherein the side walls of said chambers provide circumferential bearing support for said gear and pawl members, and the latter two members are in mutual bearing engagement.

* * * * *